US005832604A

United States Patent [19]

Johnson et al.

[11] Patent Number: 5,832,604

[45] Date of Patent: Nov. 10, 1998

[54] METHOD OF MANUFACTURING SEGMENTED STATORS FOR HELICAL GEAR PUMPS AND MOTORS

[75] Inventors: Howard E. Johnson, Kennesaw; Louis Alan Strihafka, Acworth, both of Ga.

[73] Assignee: Hydro-Drill, Inc., Kennesaw, Ga.

[21] Appl. No.: 847,341

[22] Filed: Apr. 23, 1997

Related U.S. Application Data

[62] Division of Ser. No. 638,889, Apr. 25, 1996, abandoned.

[60] Provisional application No. 60/003,422 Sep. 8, 1995.

[51] Int. Cl. [6] ..... B23P 15/00

[52] U.S. Cl. ..... 29/888.023; 29/447

[58] Field of Search ..... 29/888.023, 447, 29/448, 469, 508; 418/48, 150, 178

[56] References Cited

U.S. PATENT DOCUMENTS

| | | | |
|---|---|---|---|
| 1,892,217 | 12/1932 | Moineau | 418/48 |
| 2,409,688 | 10/1946 | Moineau | 418/48 |
| 2,527,673 | 10/1950 | Byram | 418/48 |
| 3,084,631 | 4/1963 | Bourke | 418/48 |
| 3,499,389 | 3/1970 | Seeberger et al. | 418/48 |
| 3,771,906 | 11/1973 | Bourke | 418/48 |
| 3,975,121 | 8/1976 | Tschirky | 418/48 |
| 4,211,521 | 7/1980 | Streicher | 418/48 |
| 4,676,725 | 6/1987 | Eppink | 418/48 |
| 4,697,997 | 10/1987 | White, Jr. | 418/61.3 |
| 4,863,359 | 9/1989 | Unterstrasser et al. | 418/48 |
| 5,042,150 | 8/1991 | Fraser, Jr. | 418/55.1 |
| 5,145,343 | 9/1992 | Belcher | 418/48 |
| 5,171,138 | 12/1992 | Forrest | 418/48 |
| 5,171,139 | 12/1992 | Underwood et al. | 418/48 |

FOREIGN PATENT DOCUMENTS

| | | | |
|---|---|---|---|
| 2408186 | 8/1975 | Germany | 418/48 |

*Primary Examiner*—I. Cuda

*Attorney, Agent, or Firm*—Thomas, Kayden, Horstemeyer & Risley

[57] ABSTRACT

The stator for a helical gear device is formed of a plurality of duplicate disks. The disks each include a convoluted cavity having equally spaced symmetrically radially extending lobes for receiving the convex lobes of the rotor. The disks are assembled into the form of a stator by inserting the disks about a mandrel which includes convoluted lobes, so that the convoluted cavities of the disks follow the shapes of the lobes of the mandrel, thereby causing the disks to be progressively radially offset with respect to one another along the length of the stator. The stacked disks are inserted into a heated cylindrical housing so that the housing forms a shrink fit about the disks. The disks and housing are further connected by brazing, and the disks optionally have openings formed between the lobes which function as convoluted channels through the assembled stator for the passage of liquid, wiring, etc. through the stator.

9 Claims, 5 Drawing Sheets

METHOD OF MANUFACTURING SEGMENTED STATORS FOR HELICAL GEAR PUMPS AND MOTORS

CROSS REFERENCE

The present application is a division of U.S. patent application Ser. No. 08/638,889, filed on Apr. 25, 1996 abandoned, which is in turn a continuation-in-part of Provisional Patent Application Ser. No. 60/003,422, filed Sep. 8, 1995.

BACKGROUND OF THE INVENTION

1. Field of Invention:

This invention relates to a helical gear expansible chamber device useable as a motor or a pump, and useable specifically as a drilling motor for downhole oil well applications, and to the process of manufacturing the device. More particularly, the invention relates to an improved stator of a helical gear expansible chamber device which improves motor power or pumping performance of the device, particularly when used as a motor for a downhole well, and reduces the cost of manufacturing of the stator.

2. Description of the Prior Art:

Downhole drilling motors usually are of the convoluted helical gear expansible chamber construction because of their high power performance and relatively thin profile and because the drilling fluid is pumped through the motor to operate the motor and is used to wash the chips away from the drilling area. These motors are capable of providing direct drive for the drill bit and can be used in directional drilling or deep drilling. In the typical design the working portion of the motor comprises an outer housing having an internal multi-lobed stator mounted therein and a multi-lobed rotor disposed within the stator. Typically, the rotor has one less lobe than the stator to facilitate pumping rotation. The rotor and stator both have helical lobes and their lobes interengage to form sealing surfaces which are acted on by the drilling fluid to drive the rotor within the stator. In the case of a helical gear pump, the rotor is turned by an external power source to facilitate pumping of the fluid. Simply, a downhole drilling motor uses pumped fluid to rotate the rotor while the helical gear pump turns the rotor to pump fluid. In typical prior systems, one or the other of the rotor/stator is made of an elastomeric material to maintain a seal therebetween.

Usually, the lobes of the stator are formed of elastomer, with the elastomer forming a continuous internal lobed helical surface along the length of the stator. The outer portion of the stator is cylindrical and is bonded to the inside surface of the outer cylindrical housing of the motor or pump. Because of variations in the thickness of the elastomer material of the prior art stators, particularly the inwardly protruding lobes of the stator, selection of the elastomer's physical properties necessitates a compromise between a high modulus value to preserve the shape of the lobes under operating stresses and the need to affect a satisfactory seal between the inner surface of the stator and the outer surface of the rotor. As the rotor rotates and precesses within the stator, a seal is formed at each point of contact between the rotor and stator. However, it is difficult to produce satisfactory elastomer moldings which are rigid enough to prevent distortion of the geometry of the stator surface which is essential to achieve high drilling or pumping efficiencies while simultaneously having elastic recovery to perform the sealing function at the rotor/stator surface. If the stator surface is flexible enough to become distorted, fluid will "blow-by" or leak through the seal formed between the helical lobes and result in reduced torque output of the motor or, in the case of the pump, reduced flows of fluid as the head pressure increases.

In order to accommodate high torque requirements in downhole drilling (or, in the case of gear pumps, high pumping pressures), stators and rotors are typically increased in length to several "leads"—thus significantly increasing manufacturing costs. This additional length also incurs certain costs in applications where operating space is at a premium. The varying thickness in the elastomer along with the relatively thick elastomer sections which are inherent in this prior art also contribute to premature mechanical and hysteresis induced heat related failure of the elastomer. Moineau U.S. Pat. No. 1,892,217 and Bourke U.S. Pat. No. 3,771,906 disclose stators constructed from elastomeric materials of varying section thickness of the elastomer.

The advantages of a "rigid" stator over an elastomeric stator working with a rigid rotor are well known and documented. Rigid convoluted helical stators are disclosed in Byram U.S. Pat. No. 2,527,673 and Forrest, U.S. Pat. No. 5,171,138. However, it is expensive to construct a stator having internal helically lobed surfaces which are accurately formed for working with a rigid rotor. Most manufacturing processes to produce long internal multi-lobe helixes are either very tooling intensive, such as helical broaching or casting, or very slow, such as electric discharge machining, or both. In any case it is very expensive to produce the long stators. This is further compounded in the great variety of sizes and geometric configurations of rotor/stator combinations.

The use of a rigid stator, rather than an elastomeric stator, substitutes for the softer inwardly projecting thick lobes the more rigid lobes which allows for very high torsional forces to be transmitted. Although an elastomer may still be used in pumps or motors having this type of stator at the interface between the rotor and stator to coat the stator and avoid metal-to-metal contact between the rotor and stator, the function of the elastomer is primarily to provide a resilient seal between the rotor/stator, and to help compensate for machining variations and tolerances. The low modulus elastomer sleeve is not required to maintain the "geometry" of the stator lobes under conditions of high unit loading, which is a job ill suited to a low modulus material.

The prior art teaches that a rigid helical stator with a thin uniform elastomeric sealing member on its lobed surfaces is superior in performance to typical elastomeric stators of relatively thick and varying cross-sections. Therefore, the problem has not been in determining what to make, it has been in finding a method of manufacturing a rigid stator that is economical.

To solve the problem of forming elongated stators for helical gear pumps, U.S. Pat. Nos. 3,975,120 and 3,975,121 teach the concept of forming a stator with a plurality of disks or "wafers", each disk having a central opening formed in the cross sectional shape of the rotor chamber, with the stators stacked in abutment with one another and progressively rotated with respect to one another to form the helical shape of the rotor chamber.

While forming a stator of multiple stacked wafers is taught by the prior art, stators formed of wafers are not in common use, apparently because of the cost of production and the difficulty of maintaining the alignment of the wafers during the operation of the device. For example, U.S. Pat. No. 3,975,121 teaches the securement of the wafers in a static position by aligning the wafers in the desired arrangement and then drilling holes through the wafers and running alignment pins through the holes. Another method is the use of notches and slots between the wafers and the outer housing and inserting a key in the slots to fit into each of the notches, and welding the assembly together.

Thus it can be seen that there is a need for a Moineau pump/motor having a stator that is extremely rigid and which forms the internal helical lobes that form the rotor cavity, which is inexpensive to produce and is durable and reliable in operation.

SUMMARY OF THE INVENTION

The present invention demonstrates a cost effective manufacturing method to manufacture an improved complex multi-lobed deep internal rigid helical stator.

Briefly described, the present invention comprises a convoluted helical gear expansible chamber device useable as a pump or as a motor and the method of producing the device. The present invention overcomes certain disadvantages of the prior known helical gear motors of the type used for downhole oil well applications by incorporating a rigid stator inside the motor housing. This rigid stator is formed by stacking a plurality of relatively thin wafers having the required stator lobe geometry formed on the inside surface of each wafer. The wafers are progressively rotationally offset from one another to achieve the required helix and then are fixedly attached to the inside of the stator housing, thus forming a stepped helical stator. A thin, substantially uniform elastomeric or other sealing material may then be molded, cast, or otherwise formed and attached to the inside of the stator, or, this sealing material may be attached to the rotor. In some cases, the sealing material may even be eliminated.

The wafers may be stamped, cast, milled, laser cut, or other inexpensive high volume low cost forming operation. High cost helical forming operations to construct the stator are avoided because the helix of the stator is approximated by rotating the wafers. The accuracy of the helix approximation is determined by the thickness of the wafers—the greater the required accuracy, the thinner the wafers must be. Should extreme accuracy be required, a true helix could be machined into each individual wafer by using a five axis mill or common EDM die sinker at a reasonable cost. Since the wafers can be very thin, only shallow helixes need to be formed, thereby eliminating the difficulty and high cost involved in producing deep internal helixes.

Once the wafers have been formed, as by stamping, they are assembled on a lobed mandrel, by sliding the disks onto the mandrel. The lobes of the mandrel are helical, so that the disks become self aligned on the mandrel, with each disk being rotated slightly with respect to the next adjacent disks. The disks are pressed together by the tightening of nuts on the end threads of the mandrel. The mandrel and its disks are then inserted into a heated cylindrical housing. The cylindrical opening of the housing normally is of slightly smaller diameter than the outside diameter of the assembled disks; however, the heating of the housing causes the housing to expand and the assembled disks can be slid into the housing. Once assembled, the disks and the housing assume approximately the same temperature, and a "shrink fit" is achieved between the disks and the housing, so that the disks become immobile within the housing. At this point in the production process the mandrel can be removed from the assembled disks.

In one process of the invention, the disks are die cut or otherwise formed with perimeter notches. When the disks are assembled on the mandrel, the notches of the disks form helical grooves on the external surfaces of the assembled disks. Copper wires are inserted in the external helical grooves of the disks, so that when the disks and the mandrel are inserted into the heated cylindrical housing, the copper wires are interposed between the surfaces of the disks and the housing. The assembled stator is then heated to a temperature higher than the melting temperature of copper wires, so that the cylindrical housing and the assembled disks are brazed together, further assuring the permanent fixation of the disks with respect to one another and with respect to the cylindrical housing.

In another embodiment, the copper wires, instead of being placed in the helical grooves formed by the external notches of the aligned disks, are simply laid in the rotor chamber formed by the assembled disks. When the assembly is heated to a temperature higher than the melting temperature of the copper wires, the parts of the assembly are brazed together, which further rigidifies the assembly. There are many other brazing alloys available which could be used for the same or dissimilar metals in lieu of copper, such as copper-zinc, copper-silver, and nickel-cobalt.

In another embodiment, each disk is stamped with openings formed adjacent the perimeter of the disks, externally of the central openings of the disks. When the disks are aligned on the helical mandrel, the perimeter openings of the disks become helically aligned and form a helical channel through the assembled stator. The channel can be used for the passage of liquid through the stator during the operation of the device. The liquid can be used for controlling the temperature of the motor and for supplying extra liquid to the drill assembly, so as to flush the cuttings and loose dirt, debris, etc. from about the drill bit to bring this material to the surface of the wellhead.

Thus, it is an object of this invention to provide an inexpensive and durable stator for a helical gear device.

Another object of this invention is to provide an improved segmented stator for helical gear pumps and motors, which is inexpensive to produce and to operate, and which has an increased resistance to internal pressure within the device.

Another object of this invention is to provide a helical gear pump and motor device which includes a convoluted stator formed of metal, with a thin elastomeric membrane of substantially uniform thickness bonded to the surfaces of the helical rotor chamber.

Another object of this invention is to provide a helical stator for a Moineau pump and motor, with the helix shape formed of metal rather than rubber, whereby the stator is able to develop much higher torque or to produce much higher head pressures than conventional stators of the same length.

BRIEF DESCRIPTION OF THE DRAWINGS

The present invention will be more fully understood by reference to the following detailed description of a typical embodiment of the present invention when read in conjunction with the accompanying drawings.

DETAILED DESCRIPTION OF PREFERRED EMBODIMENT

Figure 1:
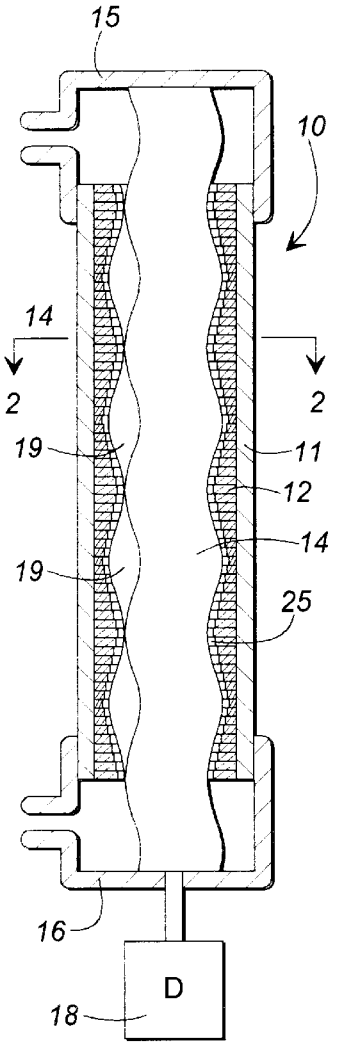
FIG. 1 is a cross-sectional illustration of a helically lobed expansible chamber device, useable as a pump or as a motor, and embodying the stepped helix disk stator construction.

Referring now in more detail to the drawings, in which like numerals indicate like parts throughout the several views, FIG. 1 illustrates a helical gear expansible chamber device 10 which can be used as a pump or as a motor, and which has its principal use as a drilling motor for downhole oil well applications. The motor comprises an external cylindrical housing 11, a stator 12 rigidly mounted within the cylindrical housing 11, rotor 14 and end caps 15 and 16. A drill bit or similar power takeoff device 18 is attached to rotor 14.

Rotor 14 is an elongated helically lobed structure of conventional design. Stator 12 is also an elongated helically lobed structure, having at least one more lobe than the rotor 14. This causes spaces 19 to be formed between the rotor and the stator along the length of the structure. When the rotor rotates with respect to the stator, the spaces 19 progressively move along the length of the structure, from one end to the other end, depending on the direction of rotation of the rotor. The end caps 15 and 16 admit liquid to or discharge liquid from the ends of the rotor and stator.

Figure 2:
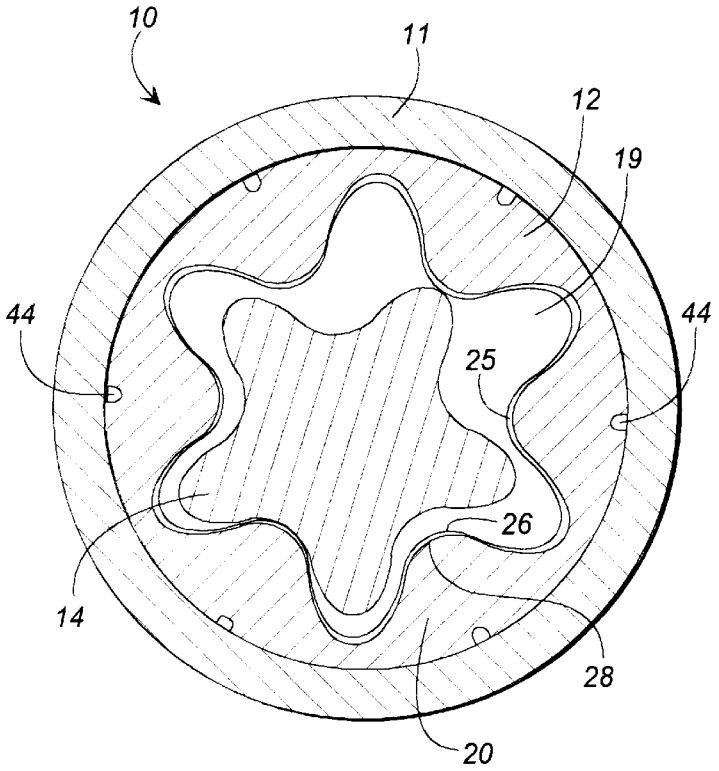
FIG. 2 is a cross-sectional view thereof, taken along lines 2—2 of FIG. 1.
Figure 3:
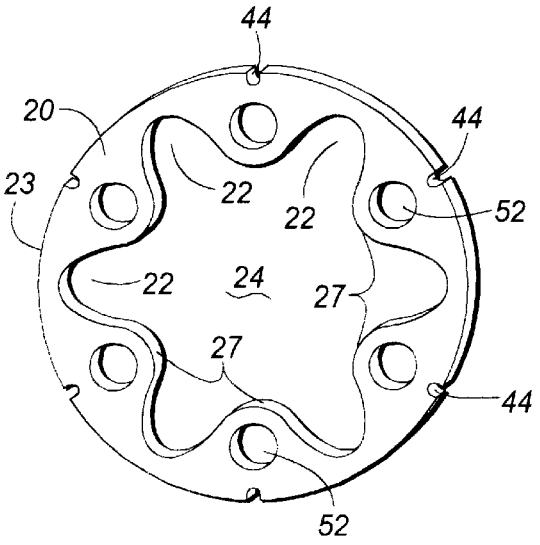
FIG. 3 is a perspective illustration of a single disk of the stator.
Figure 4:
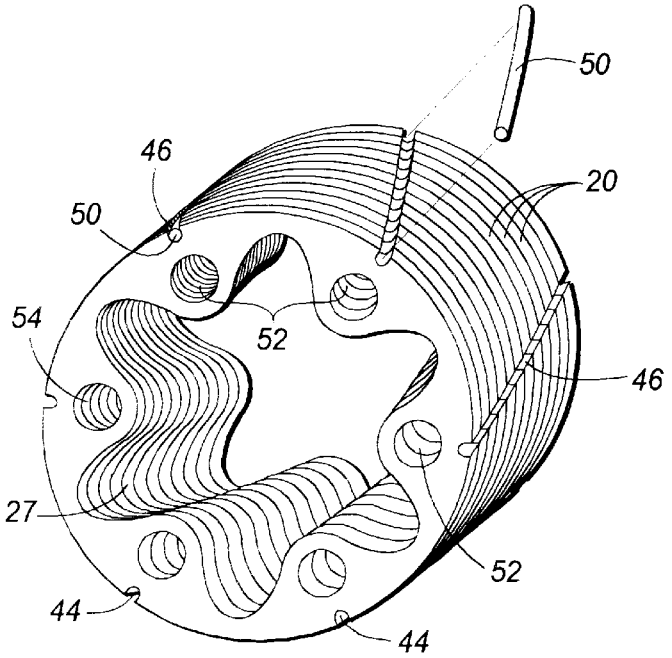
FIG. 4 is a perspective illustration of several disks of the stator, showing how the disks are stacked with respect to one another and progressively rotationally angled with respect to one another.

As shown in FIGS. 2, 3 and 4, the stator 12 is formed of a series of disks 20. Each disk includes a convoluted cavity 21 (FIG. 3), with the embodiment illustrated having six equally spaced symmetrically radially extending lobes 22. The periphery 23 of the disk 20 is circular. As shown in FIG. 4, all of the disks 20 are of substantially identical construction, with their internal and exterior dimensions and shapes being the same.

After the disks have been stamped, the disks are deburred by conventional means, as by placing the disks in a vibrating container (not shown) with shot or sand or other medium that smooths any jagged edges of the disks.

In order to form a multitude of the disks 20 into a convoluted helical stator, the disks are stacked in longitudinal alignment (FIG. 4), and each disk is rotated about the central axis 24 progressively with respect to the next adjacent disk. For example, the disks can be formed in a width of ⅛ inch and rotated between 1 and 2 degrees with respect to the next adjacent disks progressively along the length of the stator to be formed by the disks, so that the lobes of each disk form with the other lobes a longitudinally twisted or helical lobed internal stepped surface 27, thus forming the internal shape of the stator.

Figure 5:
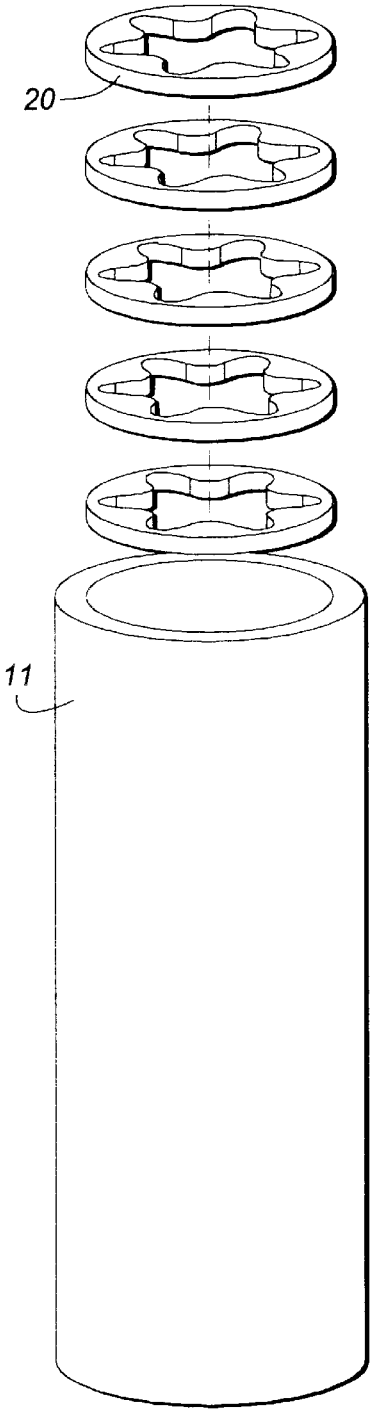
FIG. 5 is an expanded perspective illustration of the disks and cylindrical housing of the stator, showing how the disks are telescopically fit within the stator.
Figure 6:
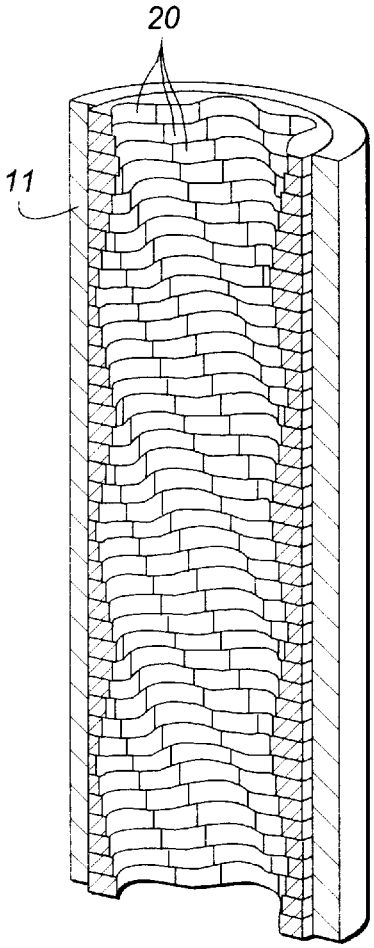
FIG. 6 is a perspective cross section of the cylindrical housing of the stator, with the disks assembled therein.

FIG. 5 illustrates that the disks 20 are longitudinally aligned and stacked within the cylindrical housing 11, and FIG. 6 illustrates, in cross-section, the general appearance of the stator structure after the disks have been longitudinally aligned and rotationally angled with respect to one another, showing the progressively rotated helical lobe configuration formed by the disks.

Figure 7:
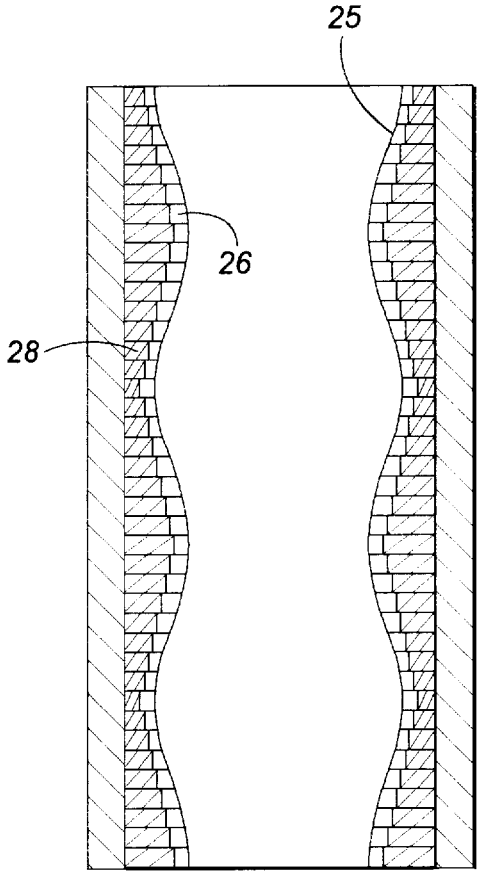
FIG. 7 is a close-up view of the stator, showing the substantially uniform coating of elastomeric material applied to the interior surfaces of the stator disks.

FIGS. 1, 2 and 7 illustrate a substantially uniform thickness elastomeric sleeve 25 which is formed on the inwardly facing surfaces of the stator. The elastomeric sleeve is bonded to the surfaces of the stator and form a substantially smooth interior surface against which the rotor 14 works.

FIG. 7 illustrates, in more detail, the elastomeric sleeve 25. While the internal surface 26 of the sleeve 25 is substantially smooth, the external surface 28 of the sleeve which is adjacent the disks 20 is progressively stepped from one disk to the next. Therefore, the sleeve effectively smooths out the internal surface of the stator and provides the resilient working surface of the stator. However, sleeve 25 is substantially uniform in thickness about its length and circumference and the sleeve is much thinner than the typical elastomeric stator of the prior art, so that the sleeve 25 does not yield significantly with respect to high internal fluid pressures typically experienced in this type of motor/pump device. Further, the stepped exterior surface of the sleeve assures that the sleeve will not be displaced either rotationally or longitudinally with respect to the stator.

Figure 9:
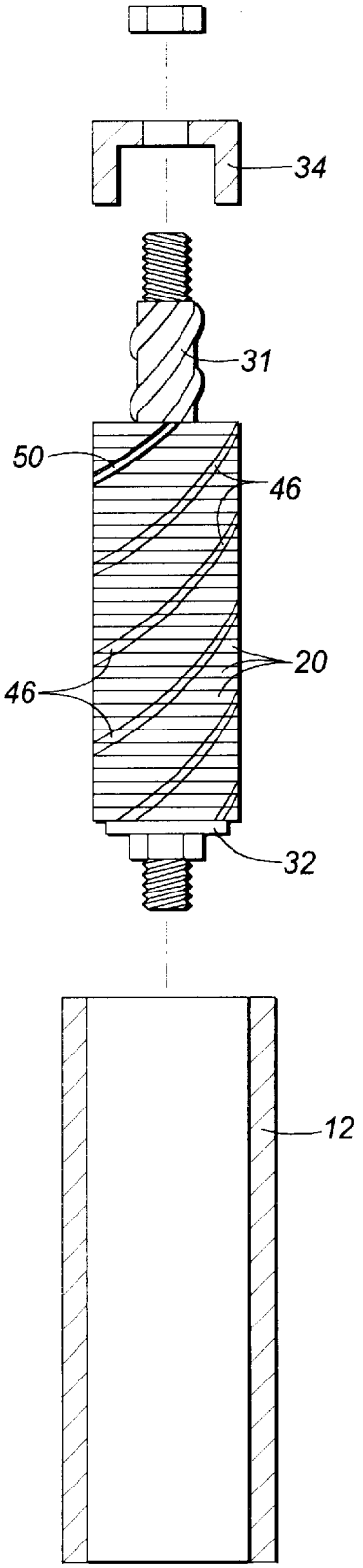
FIG. 9 is an expanded illustration of the manufacturing process by which the stator is produced.
Figure 10:
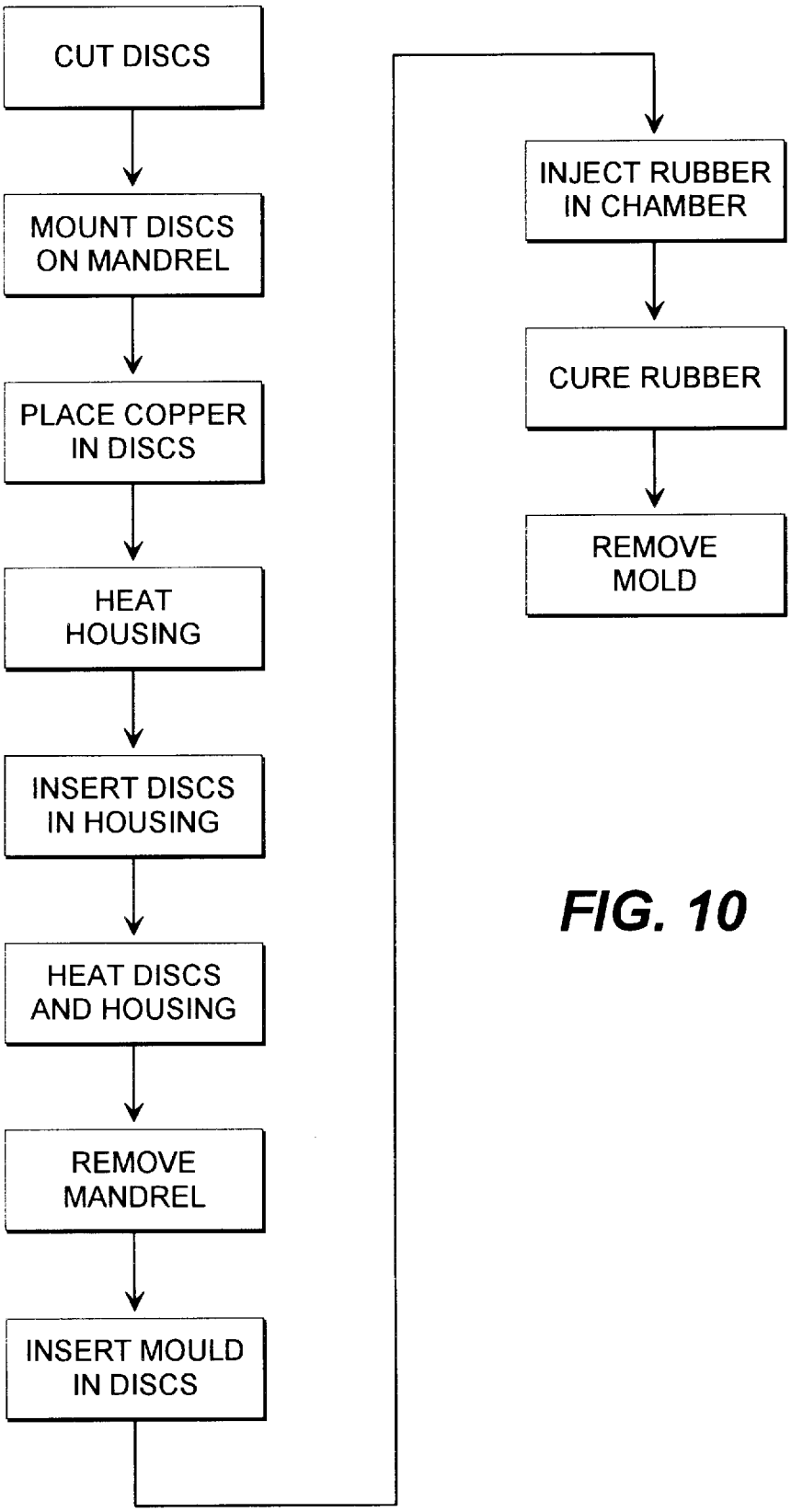
FIG. 10 is a block diagram illustrating the procedures for producing the stator.

In order to construct the stator 12, the individual disks 20 (FIG. 3) are stamped or otherwise formed from sheet material such as 4130 steel or other metals, with each disk having a circular exterior surface and a cylindrical convoluted cavity, with all of the disks being the same size and shape. The disks are then mounted on a positioning mandrel 31 (FIG. 9). The mandrel has convoluted lobes that are sized and shaped so as to correspond to the size and shape of the interior surfaces of the disks 20, with the lobes of the mandrel formed in a helix and requiring the disks moved onto the mandrel to follow the helix and to be rotationally offset with respect to the next adjacent disks. Thus, the shape of the mandrel 31 and the thickness of each disk 20 determines the angular offset of the disks with respect to one another. Since the mandrel is to be removed from the disks during a later step in the process, the mandrel is formed of a size S slightly smaller than the cavities 21 of the disks.

Figure 8:
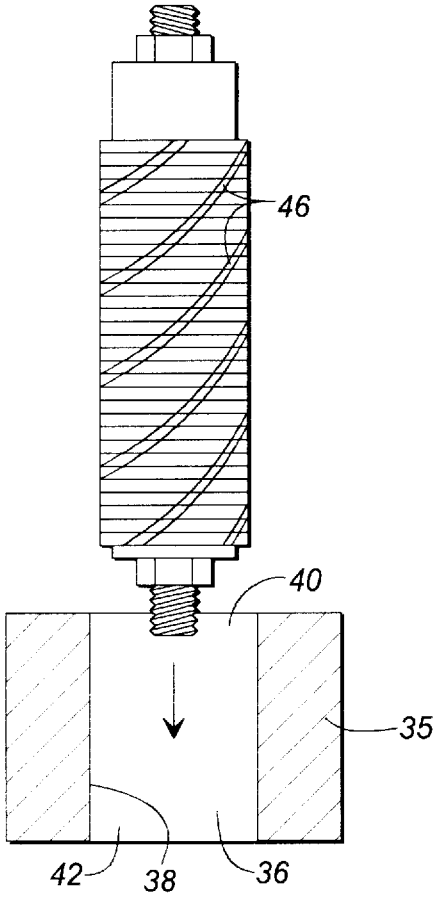
FIG. 8 shows how the assembled disks and mandrel are moved through a swaging tool for aligning the exterior surfaces of the disks.

The disks 20 are then clamped together in their stacked and angular offset relationship on the mandrel by end caps 32 and 34 on mandrel 31. As illustrated in FIG. 8, in order to make sure that the cavities 21 of the disks are properly aligned, and to make sure that the external circular surfaces of the disks are aligned, the disks and the mandrel may be passed through a swaging tool 34 or turned to provide uniform outside diameter. The swaging tool includes a tapered passage 36 formed by a tapered sidewall 38. The passage 36 includes a larger entrance end 40 and a smaller exit end 42, so that the cross sectional area of the tapered passage 36 decreases from the entrance end to the exit end. The size and shape of the exit end 42 is the desired size and shape of the circular exterior surface of the disks once the disks and the mandrel have passed through the swaging tool. The movement of the disks and mandrel through the swaging tool forces the disks into exterior alignment with one another, which also results in better alignment of the internal cavities of the disks. The disks and the mandrel, in their clamped configuration, are placed in the external cylindrical housing 12 as shown in FIG. 9. Typically, the housing 12 will be heated to about 600° above room temperature so as to be expanded and provide adequate space for receiving the disks 20. Once the disks 20 and mandrel 31 have been inserted into the hot cylindrical housing 12, their temperatures begin to equalize, causing contraction of the housing about the disks, to form a tight shrink fit of the housing about the disks. This permanently freezes the disks in position in the housing.

Once the disks have been received in the housing and the shrink fit between the disks and housing has been accomplished, the mandrel 31 can be removed from the disks. Since the disks did not form a rigid relationship with respect to the slightly smaller mandrel, the mandrel can be slid out of the disks after the end caps of the mandrel have been removed.

As illustrated in FIGS. 2 and 3, the disks can be formed with notches 44 equally spaced about their perimeters, with each notch being aligned with the increased thickness lobe 27 of the disk. When the disks are assembled on the mandrel 31 (FIG. 9), the notches 44 become helically aligned, so as to form helical grooves 46 about the exterior cylindrical shape of the stacked disks.

As shown in FIGS. 4 and 9, after the stacked disks 20 have been assembled on the mandrel, but before the mandrel and disks have been inserted into the housing 12, copper wire 50 or other metallic wire having a temperature of melting that is lower than the temperature of melting of the disks and the housing 11, is laid into the helical grooves 46. The size of the copper wire is chosen so that a friction fit is made between the wire and the helical grooves 46, so that the wire is firmly held in position within the grooves and does not protrude beyond the cylindrical surface of the stacked disks.

When the stacked disks 20 and mandrel 31 are inserted into the hot housing 12, the copper wires 50 will be interposed between the disks and the housing, and substantially uniformly dispersed about the structure.

After the disks, mandrel and copper wires have been assembled in the housing with a shrink fit, the mandrel is removed, and the assembled housing, disks and copper wires are placed in an oven, where the temperature of the assembly is raised to a level greater than the melting temperature of the copper wire, usually 2050° F., in a protective atmosphere, such as nitrogen, hydrogen, or in a vacuum, for a period of about ten minutes, or other length of time sufficient to melt the copper wire. This results in a brazing action between the metals, where the melted copper wicks by capillary action between all of the adjacent surfaces of the structure, thereby rigidly and permanently bonding the elements of the structure together.

As an alterative to the placement of copper wire in the helical grooves 46 of the stacked and assembled disks 20, copper wiring can be simply laid in the rotor cavity formed by the assembled disks after the shrink fit has been achieved between the disks and the housing 12 and after the mandrel 31 has been removed from the assembly. The above described heating step then takes place, whereupon the copper wire melts and the copper becomes dispersed and a braising action takes place to join the facing surfaces of the elements together. Again, this results in a metal brazed permanent and rigid connection between the elements of the structure.

As an alternative to the step of brazing the metals into a unitary structure, the stacked disks 20 and housing 11 can be rigidly and permanently connected together by electron beam welding. The assembled structure, in its shrink fit configuration and without the mandrel, is placed in an electron beam welder, in a vacuum, and weld lines are formed through the housing, between the disks and the housing, and between adjacent disks, preferably at the portion of the disks which includes the enlarged lobe areas 27. This procedure is relatively fast, with the bonding of the metals taking place at approximately 30 inches per minute for each welding line, and a relatively low amount of heat is generated from this procedure. This eliminates any tendency of the warping of the disks. A suitable welder for this purpose is the Sciaky Electron Beam Welder.

Another alternate process for rigidly and permanently connecting the disks to one another and to the housing is chemical bonding. The facing surfaces of the housing and the disks are coated with a chemical compound, such as sal-ammoniac and sulphur, which tends to corrode the metal surfaces. After coating, the housing and the stacked disks are telescopically assembled as described above. The chemical compound tends to oxidize the facing surfaces of the structure, so that a permanent bond between the structures is formed.

In order to apply the elastomeric sleeve 25 to the internal surfaces of the disks 20, a second mandrel, similar to mandrel 31, is inserted into the cavity formed by the disks. This second mandrel is of approximately the same configuration as the elongated convoluted helical cavity formed by the disks 20, but is slightly undersized so as to form a substantially uniform space between the mandrel and the facing surfaces of the disks. Once the mandrel is in position in the helical convoluted cavity of the disks, the elastomeric material is extruded or poured into the space formed between the mandrel and the facing surfaces of the disks, thereby forming the sleeve 25. The temperature of the structure is then controlled so as to cure the elastomeric material, as may be necessary. Once the elastomeric material has been cured, the mandrel is removed, leaving the sleeve substantially in the configuration as illustrated in FIG. 7. At this stage, the stator has been substantially completely formed and is ready for being assembled with the rotor 14, end caps 15 and 16, power takeoff device 18, and other components.

As illustrated in FIGS. 3 and 4, additional holes 52 can be die cut or otherwise formed in the thicker lobed area 27 of the disks. When the disks are assembled (FIG. 4), the holes 52 form helical passages 54 through the assembled disks. The passages 54 can be used to transmit liquid through the stator during use of the assembled motor 10. The liquid moving through the helical passages 54 cools and otherwise controls the temperature of the stator. Moreover, while the liquid expelled from the motor that is used to power the motor and drive the drill bit is used to remove the cuttings and other debris from about the drill bit 18, additional liquid is usually required for this purpose. Therefore, the liquid passing through the helical passages 54 can be used for this purpose.

While circular holes 52 are shown in FIGS. 3 and 4, a similar function can be achieved without the use of holes 52, by enlarging the notches 44 at the perimeter of the disks 20. The enlarged notches form enlarged helical grooves 46. Once the copper wire has been liquified and performs its brazing function, the helical grooves 46 will be substantially empty and the space of the grooves can be used to transmit the liquid through the stator, as described above.

While the circular holes 52 and notches 44 are described as useful in passing liquid through the stator, these passageways also can be utilized to pass a hydraulic line through the stator, or pass an electrical wire through the stator, so as to control a function below the motor in the well hole.

Although the preferred embodiments describe the external cylindrical housing and the disks being made of metal, these items can be made from other materials and combinations of materials, depending on the intended application.

While preferred embodiments of the invention have been disclosed in detail in the foregoing description and drawings, it will be understood by those skilled in the art that variations and modifications thereof can be made without departing from the spirit and scope of the invention as set forth in the following claims.

What is claimed is:

1. A process of making a stator for a helical gear expansible chamber device of the type having an elongated rotor with convex helically convoluted lobes, and an elongated stator having an elongated chamber for receiving said rotor, said chamber defining concave helically convoluted lobes, said chamber defining at least one more lobe than said rotor, said process comprising;

forming a plurality of substantially identical metal disks, each of said disks defining in cross-section a rotor opening defining radially extending lobes corresponding to the size and shape of said rotor, placing the disks in aligned face-to-face stacked relationship with one another, with each disk rotated with respect to the next adjacent disks progressively along the length of the aligned disks in one direction of rotation to form the lobes of the disks into a concave helically convoluted chamber;

inserting the stacked disks in a cylindrical housing, and connecting the disks to said housing with a shrink fit in substantially rigid relationship with respect to said housing.

2. The process of claim 1 and wherein the step of placing the disks in aligned face-to-face abutting relationship comprises mounting the disks with their openings positioned about a helically lobed mandrel of a breadth less than the openings of said disks, and passing the mandrel and disks through a swaging member to align the disks.

3. The process of claim 1 and wherein the step of forming the disks comprises forming the disks with perimeter notches, wherein the notches of the disks form a helical channel on the outer surfaces of the stacked disks.

4. The process of claim 3 and further including placing brazing material in the helical channels and heating the brazing material to its brazing temperature.

5. The process of claim 3 and wherein the step of forming the disks comprises die cutting metal sheet material into a disk shape.

6. The process of claim 3 and wherein the step of forming the disks comprises forming the disks with internally projecting lobes, and forming openings in said lobes, so that when the disks are aligned in a stack, the openings form helical channels through the stack.

7. A process of making a stator for a helical gear expansible chamber device of the type having an elongated rotor with convex helically convoluted lobes, and an elongated stator having an elongated chamber for receiving said rotor, said chamber defining concave helically convoluted lobes, said chamber defining at least one more lobe than said rotor, said process comprising;

forming a plurality of substantially identical metal disks, each of said disks defining in cross-section an opening defining radially extending lobes corresponding to the size and shape of said stator, placing the disks in aligned face-to-face stacked relationship with one another, with each disk rotated with respect to the next adjacent disks progressively along the length of the aligned disks in one direction of rotation to form the lobes of the disks into a concave helically convoluted chamber;

inserting the stacked disks in a cylindrical housing, and metal brazing the disks to adjacent disks and to said housing.

8. The process of claim 7 and wherein the step of forming a plurality of disks comprises forming notches in the perimeters of the disks, wherein the step of placing the disks in stacked relationship includes arranging the notches of the disks in a helical channel, wherein the step of metal brazing the disks comprises placing brazing metal in the helical channels of the stacked disks and heating the brazing metal to a temperature sufficient to melt the brazing metal.

9. A process of making a stator for a helical gear expansible chamber device of the type having an elongated rotor with convex helically convoluted lobes, and an elongated stator having an elongated chamber for receiving said rotor, said chamber defining concave helically convoluted lobes, said process comprising:

forming a plurality of substantially identical disks, each of said disks defining a centrally positioned symmetrical rotor opening with lobes corresponding to the size and shape of the size and shape of said rotor, and a circular perimeter;

placing the disks in a stacked relationship with respect to one another about a mandrel;

passing the disks and the mandrel through a swaging tool to urge the circular perimeters of the disks in alignment with one another;

inserting the disks into a housing; and bonding the disks to one another and to the housing.

* * * * *

UNITED STATES PATENT AND TRADEMARK OFFICE

CERTIFICATE OF CORRECTION

PATENT NO. : 5,832,604
DATED : 11/10/98
INVENTOR(S) : Howard E. Johnson

It is certified that error appears in the above-identified patent and that said Letters Patent is hereby corrected as shown below:

On the title page, Item [73], delete the following:
"Assignee: Hydro-Drill, Inc., Kennesaw, Ga."

Signed and Sealed this

First Day of June, 1999

*Attest:*

Q. TODD DICKINSON

*Attesting Officer*

*Acting Commissioner of Patents and Trademarks*